US007131687B2

(12) United States Patent
Yokoo et al.

(10) Patent No.: US 7,131,687 B2
(45) Date of Patent: Nov. 7, 2006

(54) WORK VEHICLE

(75) Inventors: Katsumi Yokoo, Saitama (JP); Toshifumi Ogihara, Saitama (JP)

(73) Assignees: Komatsu Ltd., Tokyo (JP); Komatsu Zenoah Co., Kawagoe (JP)

( * ) Notice: Subject to any disclaimer, the term of this patent is extended or adjusted under 35 U.S.C. 154(b) by 235 days.

(21) Appl. No.: 10/689,997

(22) Filed: Oct. 22, 2003

(65) Prior Publication Data

US 2004/0084934 A1 May 6, 2004

(30) Foreign Application Priority Data

Oct. 23, 2002 (JP) ..... 2002-308639
May 20, 2003 (JP) ..... 2003-142613
May 20, 2003 (JP) ..... 2003-142647

(51) Int. Cl.
*B62D 25/06* (2006.01)
*B62D 33/06* (2006.01)
*B60R 21/13* (2006.01)

(52) U.S. Cl. ..... 296/190.08; 296/102; 280/756

(58) Field of Classification Search ..... 296/190.08, 296/190.03, 102; 180/89.12, 89.13, 89.16, 180/69.21; 280/756, 760; 52/735.1
See application file for complete search history.

(56) References Cited

U.S. PATENT DOCUMENTS 3,687,484 A * 8/1972 Cosby ..... 280/755
3,933,371 A * 1/1976 Graham ..... 280/756
4,362,220 A * 12/1982 Baston ..... 180/68.5
4,666,183 A * 5/1987 Azzarello ..... 280/756
5,845,940 A * 12/1998 Colburn ..... 280/830
6,170,588 B1 * 1/2001 Irino et al. ..... 180/89.1
6,557,893 B1 * 5/2003 Sauermann ..... 280/748
6,578,651 B1 * 6/2003 Murase ..... 180/89.17
6,615,942 B1 * 9/2003 Shinohara et al. ..... 180/69.21

FOREIGN PATENT DOCUMENTS

| | | | |
|---|---|---|---|
| JP | 402070835 A | * | 3/1990 |
| JP | 06-048693 | | 2/1994 |
| JP | 09-025649 | | 1/1997 |
| JP | 09-328781 | | 12/1997 |
| JP | 10-128490 | | 5/1998 |
| JP | 10-140607 A1 | | 5/1998 |
| JP | 11-269928 | | 10/1999 |
| JP | 2000-309946 | | 11/2000 |
| JP | 2003-239327 | | 8/2003 |

* cited by examiner

*Primary Examiner*—D. Glenn Dayoan
*Assistant Examiner*—Greg Blankenship
(74) *Attorney, Agent, or Firm*—Posz Law Group, PLC; R. Eugene Varndell, Jr.

(57) ABSTRACT

A work vehicle comprises a counter weight (1) manufactured by casting, an outer surface thereof being formed in a substantially arc shape, the counter weight (1) including at a lower section thereof an extended portion extending in leftward and rightward directions to have a substantially arc shape, tip ends of the extended portion and a lower part of a center section of the counter weight (1) being provided with a lower attachment base, and an upper face thereof being provided with a canopy attachment base; and a canopy (2) including a roof (22), pillars (21) standing at left side and right side for supporting the roof (22), and a lower attachment member (23) manufactured by casting for fixing lower ends of the pillars (21), the canopy (2) being mounted on the counter weight (1).

15 Claims, 11 Drawing Sheets

WORK VEHICLE

BACKGROUND OF THE INVENTION

1. Field of the Invention

The current invention relates to a work vehicle.

2. Related Art

FIG. 9 illustrates an exemplary small hydraulic excavator commonly used for public engineering works in urban areas. The small hydraulic excavator includes a counter weight 100 provided at the opposite side of a working machine 90, and a canopy 200. The counter weight 100 works for allowing the vehicle to be balanced with the load applied to the working machine. In order to ensure an operator's safety when the vehicle falls down, recent increasing demands for improved safeties require driver protection structures to conform to the strength standard specified by the ISO standards. Specifically, more canopies or cabs are required to have a Roll-over Protective Structure (ROPS).

FIG. 10 is an exploded perspective view illustrating a conventional ROPS canopy attached to a small hydraulic excavator. As shown in FIG. 10, a ROPS canopy support member 110 construct by metal sheet is attached to a frame 150 to support a canopy 210 construct by metal sheet so that the whole structure has a prescribed strength, thereby providing the ROPS canopy (refer to, for example, "Bobcat, Model 56 Hydraulic Excavator Parts Manual", Melroe Company, November, 1986, p.A3).

Another structure is also known as shown in FIG. 11. In this structure, a counter weight 120 is provided to extend upwardly. The counter weight 120 has at the upper end side a support member 221 for supporting a canopy 220 (refer to, for example, Japanese Patent Laid-Open Publication No. 10-140607 (pp. 2–5, FIGS. 1–6).

However, the conventional ROPS canopy support member 110 as shown in FIG. 10 has a metal plate structure and thus has a problem in that the ROPS canopy support member 110 has a complicated structure having an increased weight in order to support the ROPS canopy 210 to ensure a prescribed strength, thereby requiring a significantly increased manufacture cost.

Furthermore, since an engine (not shown) is provided rearward of the ROPS canopy support member 110 shown in FIG. 10, the ROPS canopy support member 110 becomes an obstacle to the inspection or maintenance works for the engine, thus causing a problem in the maintainability of the engine.

The counter weight 120 as shown in FIG. 11 is provided to extend upwardly and thus allows the center of gravity of the counter weight 120 to move toward the rear end side, thereby to improve the stability during operations. However, since the counter weight 120 is not a structure that satisfies a prescribed strength to support a ROPS canopy, the canopy 220 cannot be an ROPS canopy.

The canopy 220 also has two support members 220*a* which are provided to stand at the back of an operator seat S and which have a narrow width (refer to Japanese Patent Laid-Open Publication No. 10-140607). For an operator who must frequently check the backside for an obstacle or a human, his or her rear field of vision is not always good because of the existence of the two support members 220*a* located around the center of his or her rear field of vision.

Japanese Laid-Open Publication No. 10-140607 also discloses in the second embodiment a case in which one thick support member 220*a* is provided. In this case, the support member 220*a* is positioned just behind the operator's seat and thus the center field of vision of the operator is blocked because the support member 220*a* is positioned at the center of his or her rear field of vision.

Therefore, further improvement for the operator's rear field of vision has been desired.

SUMMARY OF THE INVENTION

The current invention was made in view of the above problems of the conventional structure.

An object of the current invention to provide a work vehicle having a ROPS canopy of a simple structure and requiring a reduced manufacture cost, having an improved maintainability and providing a favorable rear field of vision for an operator of the work vehicle.

To achieve the object of the current invention, a work vehicle according to a first aspect of the current invention comprises a counter weight manufactured by casting, an outer surface thereof being formed in a substantially arc shape, the counter weight including at a lower section thereof an extended portion extending in leftward and rightward directions to have a substantially arc shape, tip ends of the extended portion and a lower part of a center section of the counter weight being provided with a lower attachment base, and an upper face thereof being provided with a canopy attachment base; and a canopy including a roof, support members standing at left side and right side for supporting the roof, and a lower attachment member manufactured by casting for fixing lower ends of the support members, the canopy being mounted on the counter weight.

According to the first aspect of the current invention, a counter weight manufactured by casting having an outer surface having a substantially arc shape is provided. The counter weight provides at the lower section an extended portion extending in the right and left directions to have a substantially arc shape; and the tip end of the extended portion and the center lower section of the counter weight have a lower attachment base. Thus, the three lower attachment bases separated in an arc manner can be used to attach the counter weight to a frame. This allows the counter weight to be fixed to be robust against an external force. As a result, a prescribed strength required for a base of a ROPS canopy attached to the upper face of the counter weight can be ensured. The pillars provided to stand at the left and right sides to support the roof have a straight shape and thus can be made by a material having a high strength which is difficult to be subjected to a bending processing. The lower attachment member for fixing the lower end of the pillars is made by casting. Thus, the attachment section of the pillar can be provided to have a smooth shape for reducing a stress concentration. Thus, this structure can be used to easily provide a prescribed strength required for a ROPS canopy. Therefore, a ROPS canopy having two pillars and providing a superior front field of vision than that provided by four pillars can be manufactured with a lighter weight and a simpler configuration.

To achieve the object of the current invention, a work vehicle according to a second aspect of the current invention, the center section of the counter weight is provided with an inspection hole in the work vehicle according to the first aspect of the current invention.

According to the second aspect of the current invention, the counter weight has at the center part an inspection hole.

This allows an operator to perform an operation in an easier manner, including the inspection of the oil level or the exchange of a filter of the engine provided at an engine room at the front section of the counter weight.

To achieve the object of the current invention, a work vehicle according to a third aspect of the current invention, there is further provided a spacer formed with a canopy attachment tapped hole and a counter weight attachment tapped hole, wherein the canopy is mounted on the counter weight via the spacer in the work vehicle according to the first aspect of the current invention.

According to the third invention, the canopy is provided on the counter weight via a spacer through which a canopy attachment tapped hole and the counter weight attachment tapped hole are drilled. This allows, without requiring the width of the canopy attachment base of the counter weight upper face to be wider, the spacer to have a wider width to allow the canopy to have a contact with the lower attachment member with a wider width. This can ensure a sufficient attachment strength of the canopy and eliminates the need for a wider width of the canopy attachment base of the counter weight upper face, thus preventing the engine room space from being reduced.

To achieve the object of the current invention, a work vehicle according to a fourth aspect of the current invention, the spacer is provided with floor attachment sections at opposing ends thereof in the work vehicle according to the third aspect of the current invention.

According to the fourth invention, the spacer has at the left and right ends floor attachment sections. Thus, the bolt screwed with the attachment tapped hole for attaching the spacer to the counter weight is detached to allow the floor to be tilted around the hinge pin of the tilting hinge provided at the front end while being integrally fixed to the canopy. This provides the engine with a wide and open upper space, thereby allowing an operator to perform an operation in a very simple manner, including an inspection or a maintenance.

To achieve the object of the current invention, a work vehicle according to a fifth aspect of the current invention, a work vehicle comprises a counter weight; a canopy which is mounted on the counter weight and includes a roof and left and right support members for supporting the roof; and an operator seat on which an operator sits, wherein the left and right support members are disposed with an interval therebetween wider than a width of the operator seat, and are positioned in lateral sides of the operator seat and at direct lateral regions or rear regions of the operator seat.

According to the fifth invention, the two pillars of the canopy have an interval wider than the width of the operator seat. This allows the pillars to have an improved strength to a lateral load.

The two pillars of the canopy are also positioned in a region right beside an operator seat or in a rear region. Thus, an operator has a rear field of vision having no obstacles at the center part, thereby providing a favorable rear field of vision.

To achieve the object of the current invention, a work vehicle according to a sixth aspect of the current invention, an engine is provided under the operator seat in the work vehicle according to the fifth aspect of the current invention.

According to the sixth invention, the operator seat has at the lower part thereof an engine. Thus, the operator seat is provided as rear as possible.

This allows the operator's operation space to be expanded so that operationability of the work vehicle is improved and it becomes easier for an operator to get on and off the vehicle.

To achieve the object of the current invention, a work vehicle according to a seventh aspect of the current invention, the canopy includes a lower attachment member which is provided at lower parts of the left and right support members and extends around a center portion of a body of the word vehicle and which is adapted to attach the canopy to the counter weight in the work vehicle according to the fifth aspect of the current invention.

According to the seventh invention, the lower attachment member of the canopy is provided to extend around the center portion of the vehicle body. This allows the canopy to be attached at the center portion of the vehicle body, thus preventing the lower attachment member from being extruded to the outside of the vehicle body and contributing to the provision of a compact vehicle body.

To achieve the object of the current invention, a work vehicle according to an eighth aspect of the current invention, the canopy includes a lower attachment member that connects the left and right support members to each other at lower sections thereof and attaches the canopy to the counter weight in the work vehicle according to the fifth or sixth aspect of the current invention.

According to the eighth invention, the canopy includes a lower attachment member for connecting the two pillars to each other at the lower section. This allows the canopy to have a robust rectangular structure and provides a higher strength to a lateral load.

To achieve the object of the current invention, a work vehicle according to a ninth aspect of the current invention, the lower attachment member of the canopy is made by casting or forging in the work vehicle according to the seventh aspect of the current invention.

According to the ninth invention, the lower attachment member of the canopy made by casting can be provided to have a smooth shape for reducing a stress concentration.

Alternatively, the lower attachment member of the canopy made by forging allows the metal flow to flow along the surface, thus providing a higher product strength.

Thus, the lower attachment member of the canopy made by casting or a forging is always allowed to provide a higher strength to a load, thus easily providing a prescribed strength required for a ROPS canopy.

To achieve the object of the current invention, a work vehicle according to a tenth aspect of the current invention comprises a counter weight; a canopy having a roof supported by left and right support members, and a lower attachment member provided with a lower section of the two support members; and a spacer provided between the counter weight and the lower attachment member, wherein the spacer is attached to a floor on which an operator seat is provided, the spacer and the lower attachment member are fixed by a bolt, and the spacer and the counter weight are fixed by a bolt.

According to the tenth invention, the floor can be tilted around the tilting hinge provided at the front end while being integrally fixed to the canopy.

This provides the engine with a wide and open upper space, thereby allowing an operator to perform an operation in a very simple manner, including an inspection or a maintenance.

The above structure in which the counter weight is connected to the canopy via the spacer canopy allows a case in which a cabin is attached in place of the canopy to eliminate the spacer to attach the cabin to the floor, thus providing a higher degree of freedom for the structure.

To achieve the object of the current invention, a work vehicle according to an eleventh aspect of the current invention comprises a counter weight including an extended portion extending in forward and lateral directions at left and right sides of a lower section of the counter weight and provided with a lower attachment base, and a canopy attachment base provided at an upper section of the counter weight, wherein the counter weight is attached to a frame via the lower attachment base; and a canopy is attached to the counter weight via the canopy attachment base.

According to the eleventh invention, the counter weight of the work vehicle has at the lower section an extended portion extending in the lateral and forward directions and having a lower attachment base. This allows the counter weight to be attached to the frame by the lower attachment base of the extended portion.

The extended portion extending in the forward and lateral directions allows the counter weight to be fixed to be robust against an external force. As a result, a prescribed strength required for a base of a ROPS canopy attached to the upper face of the counter weight can be ensured.

Therefore, a ROPS canopy having two pillars and providing a superior front field of vision than that provided by four pillars can be manufactured with a lighter weight and a simpler configuration.

To achieve the object of the current invention, a work vehicle according to a twelfth aspect of the current invention, the counter weight has a rear outer surface having a substantially arc shape face formed about a vertical axis positioned at the front side in the work vehicle according to the eleventh aspect of the current invention.

To achieve the object of the current invention, a work vehicle according to a thirteenth aspect of the current invention, the counter weight is provided with an opening for maintenance in the work vehicle according to the eleventh aspect of the current invention.

According to the thirteenth invention, the counter weight has at the center part an opening for a maintenance purpose. This allows an operator to perform an operation in an easier manner, including the inspection of the oil level or the exchange of a filter of the engine provided at an engine room at the front section of the counter weight.

To achieve the object of the current invention, a work vehicle according to a fourteenth aspect of the current invention, the counter weight is made by casting in the work vehicle according to the eleventh aspect of the current invention.

According to the fourteenth invention, the counter weight made by casting can be provided to have a smooth shape for reducing a stress concentration.

DESCRIPTION OF THE EMBODIMENTS

Embodiment of a work vehicle according to the current invention will be described in detail with reference to the accompanying drawings.

Figure 1:
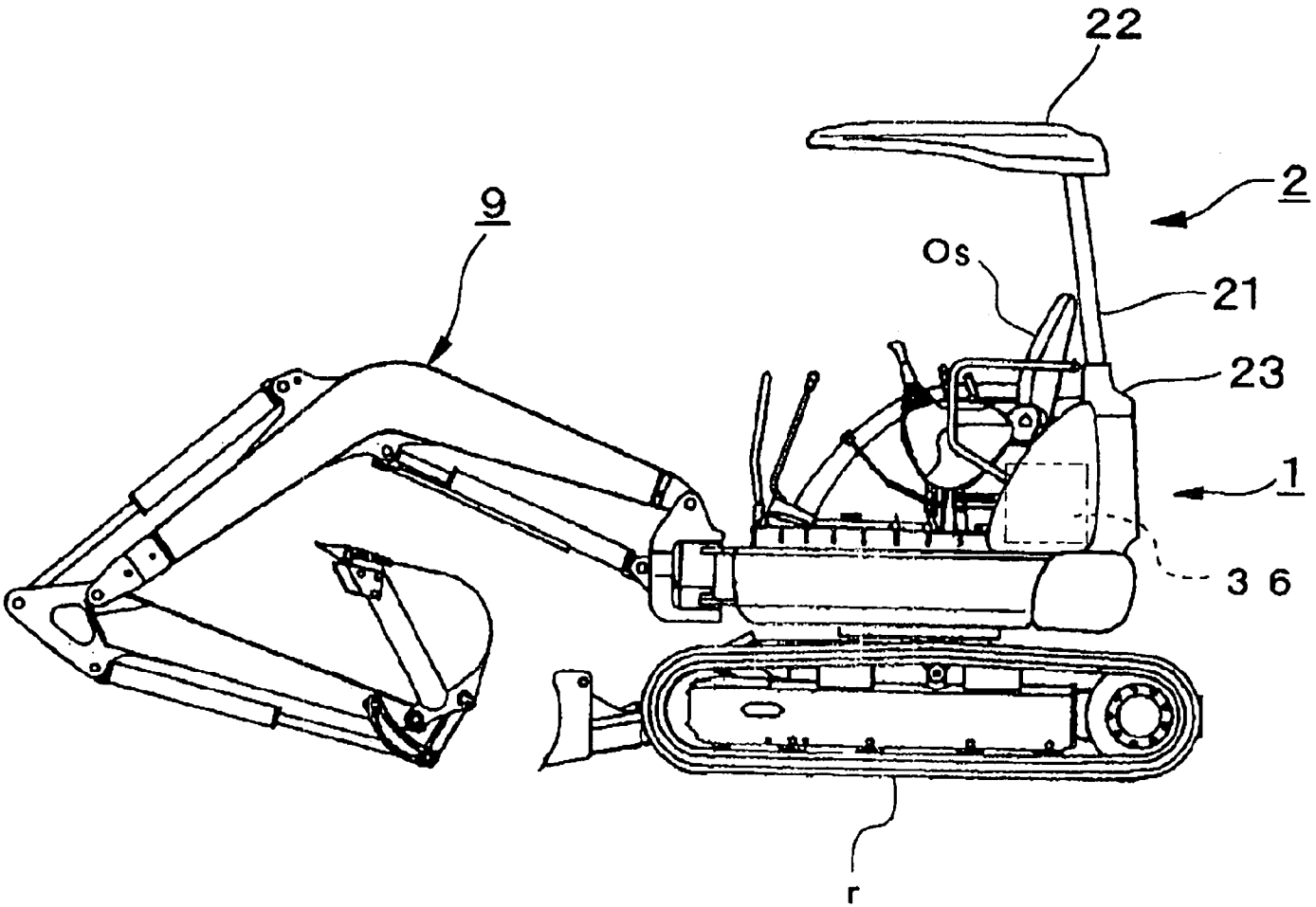
FIG. 1 is a side view illustrating an embodiment of a work vehicle according to the current invention.

FIG. 1 illustrates a side view of a small drilling vehicle as an embodiment of a work vehicle according to the current invention. As shown in FIG. 1, the drilling vehicle has a counter weight 1 at the rear end of the frame (not shown). The counter weight 1 works to provide a balance to a load applied to the working machine 9 provided at the front end of the frame.

In front of the counter weight 1, an engine 36 is provided under an operator seat Os on which an operator sits.

With this configuration, the operator seat Os can be provided toward a rear side of the vehicle body, which allows the operator's operation space in front of the operator seat Os to be expanded so that operationability of the work vehicle is improved and getting on and off the vehicle becomes easier for the operator.

Figure 3:
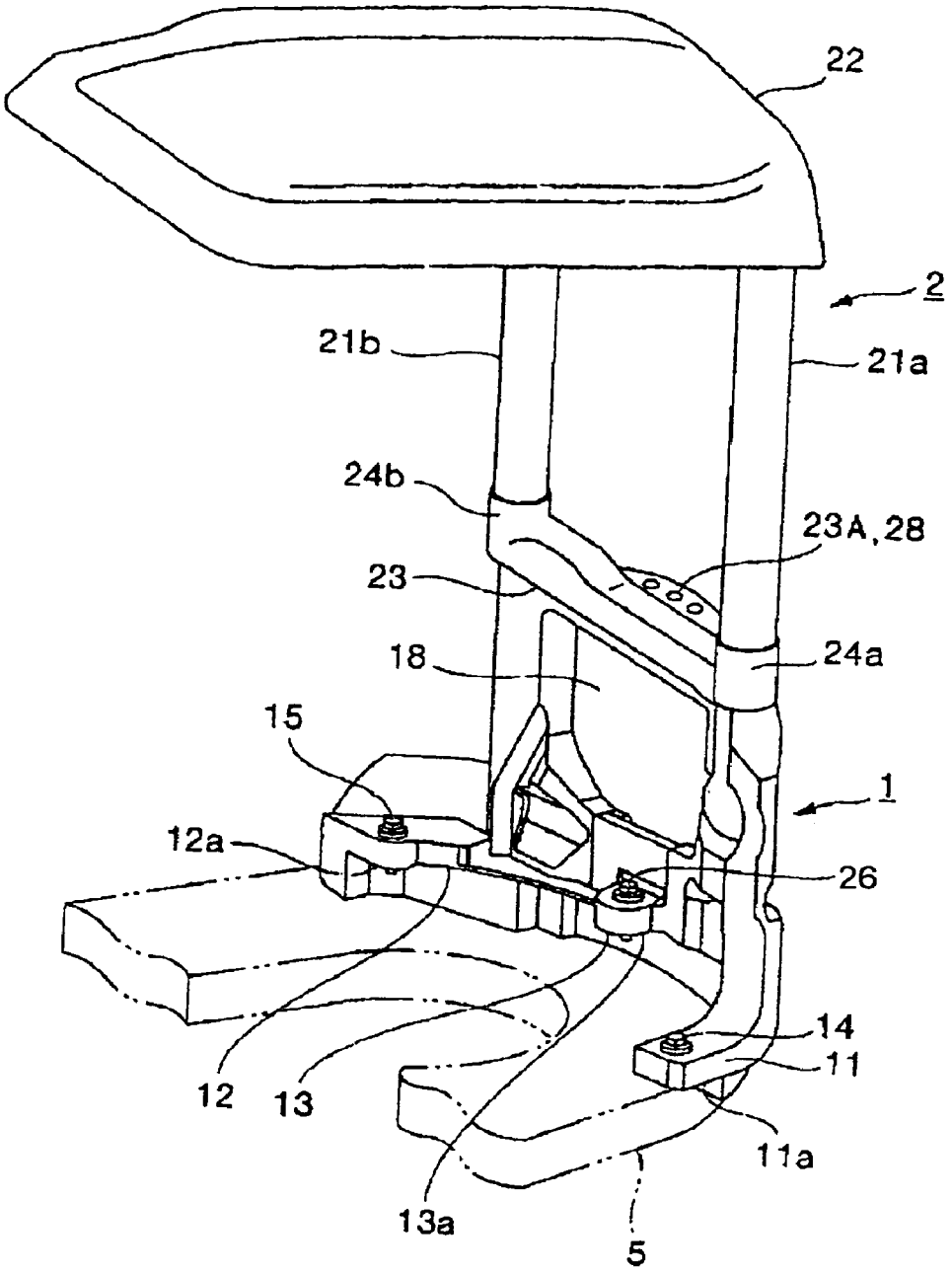
FIG. 3 is a perspective view illustrating a counter weight and a canopy mounted on the counter weight.

FIG. 3 is a perspective view illustrating the structure of a counter weight 1 and an ROPS canopy 2 provided on the counter weight 1. The counter weight 1 is made by casting to have an outer surface having a substantially arc shape, the lower section of which has an extended portion 11 extending in the left direction to have a substantially arc shape and extending in the right direction to have a substantially arc shape. A left side lower attachment base 11*a*, a right side lower attachment base 12*a*, and a central portion lower attachment base 13*a* are provided at the tip end of the extended portion 11, the tip end of the extended portion 12, and a lower section 13 at the center part, respectively. In the lower attachment base 11*a*, the lower attachment base 12*a*, and the lower attachment base 13*a* that are provided to be separated from one another to have a substantially arc shape, the counter weight 1 is fixed to a frame 5 (as shown by a two-dot chain line) by a bolt 14, a bolt 15 and a bolt 26, thus being firmly fixed to the frame 5. With this configuration, a force applied to the counter weight 1 and the canopy 2 attached to the upper face of the counter weight 1 can be sufficiently absorbed when the work vehicle falls down.

Figure 4:
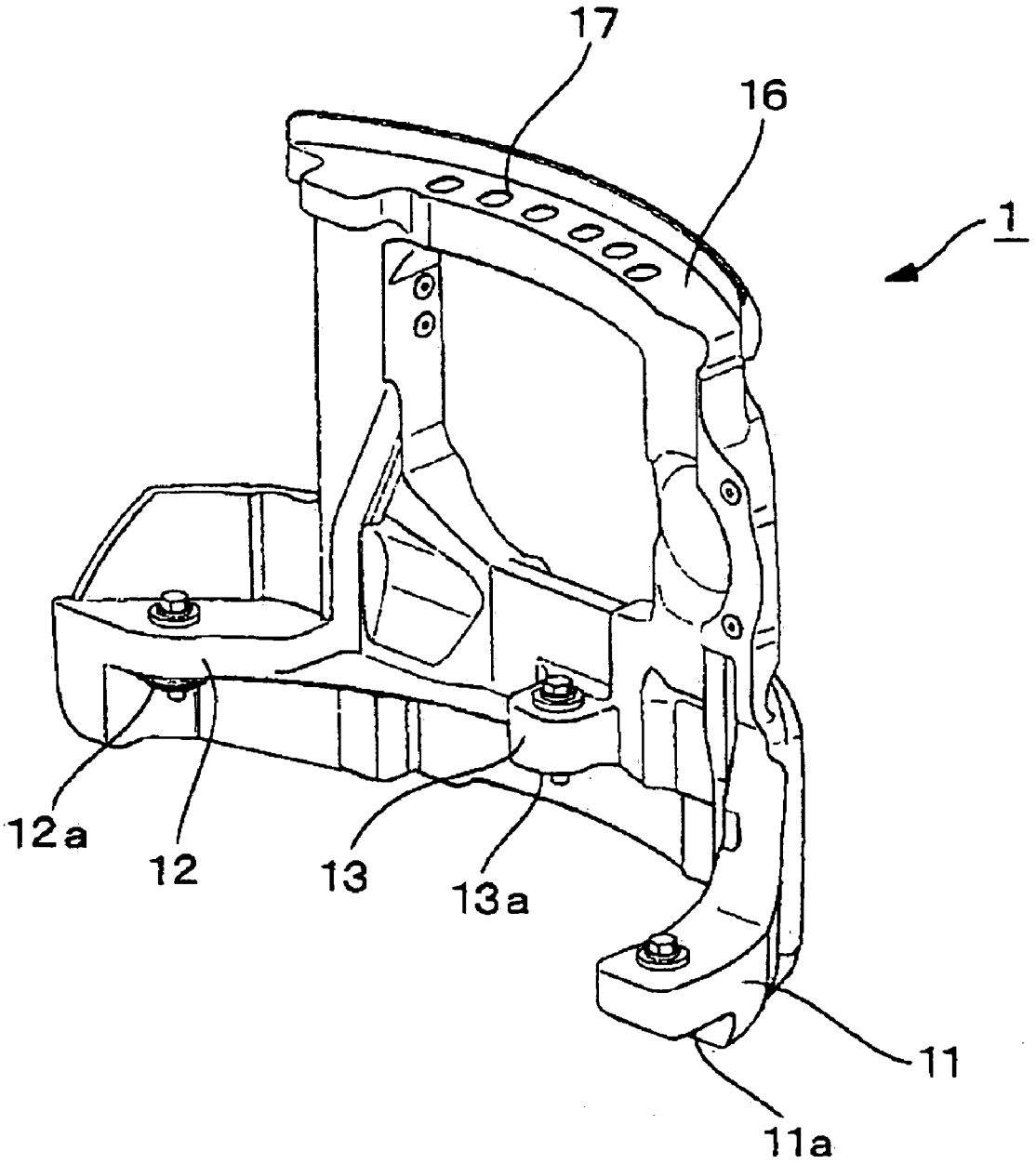
FIG. 4 is a perspective view of the counter weight.

The canopy 2 is attached to the upper face of the counter weight 1 by a plurality of bolts 28 going through a plurality of bolt holes 17 drilled in the upper face 16 of the counter weight 1 shown in FIG. 4 and bolt holes 23 A of a lower attachment bracket 23 of the canopy 2 shown in FIG. 3, the bolts 28 being tightened by nuts (not shown). The lower attachment bracket 23 is made by casting so that an attachment section 24*a* and an attachment section 24*b* of a left pillar 21*a* and a right pillar 21*b* for supporting a roof 22 are formed in appropriate shapes for reducing a stress concentration, thereby to provide an improved strength. The pillar 21*a* and the pillar 21*b* are made by straight and thick pipes so that the canopy 2 has a prescribed strength required to a ROPS canopy.

Figure 7:
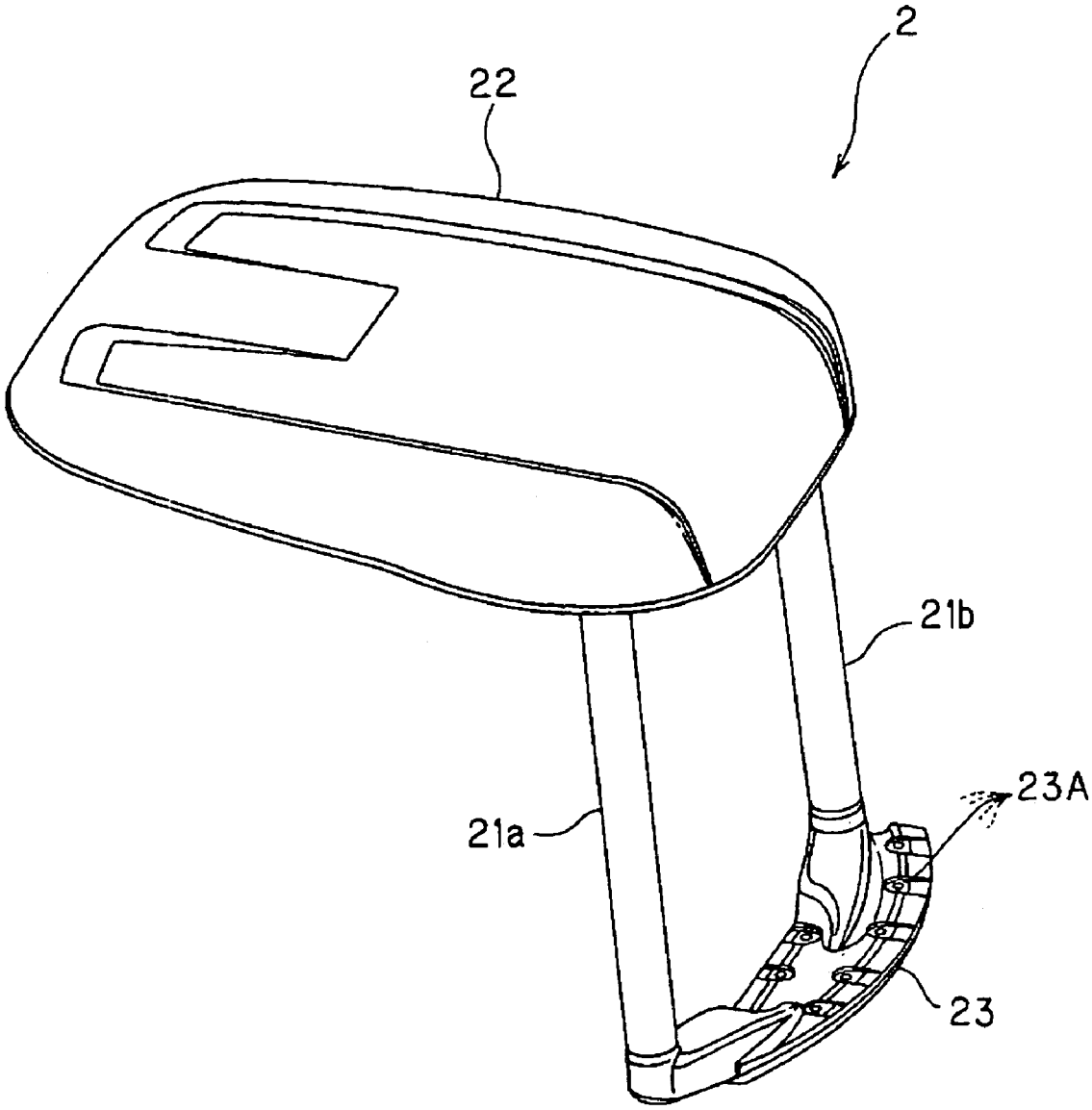
FIG. 7 is a perspective view illustrating the canopy.

As shown in FIG. 7, the lower attachment bracket 23 is provided to extend around the center of the vehicle body, and the lower sections of the pillar 21*a* and the pillar 21*b* are inserted and attached to the lower attachment bracket 23. The two pillars 21*a* and 21*b* are connected to each other by means of the lower attachment bracket 23.

With the configuration in which the lower attachment bracket 23 for attaching the canopy to the counter weight 1 is provided to extend around the center portion of the vehicle body, the canopy 2 is attached to the center portion of the vehicle body, thus preventing a space for attaching the canopy 2 from being extruded to the outside of the vehicle body, thereby making the vehicle body compact.

Further, with the configuration in which the two pillars 21*a* and 21*b* of the canopy 2 are connected at the lower section by means of the lower attachment bracket 23, the canopy 2 is formed in a robust rectangular structure, which allows the two pillars 21*a* and 21*b* to have a higher strength to a load applied from the lateral sides of the canopy 2 as compared with the structure in which the supports are separated at their lower sections.

Although this embodiment provides a structure in which the lower sections of two pillars 21*a* and 21*b* at the canopy 2 are connected via the lower attachment bracket 23, another structure may also be provided in which the two pillars 21*a* and 21*b* are not connected and are separated at the lower sections thereof.

Although this embodiment illustrates a case in which the lower attachment bracket 23 is made by casting, the lower attachment bracket 23 may be made by forging. Since the lower attachment bracket 23 made by forging has a grain flow flowing along the surface thereof, a higher product strength is provided as compared to that made by casting.

Figure 2:
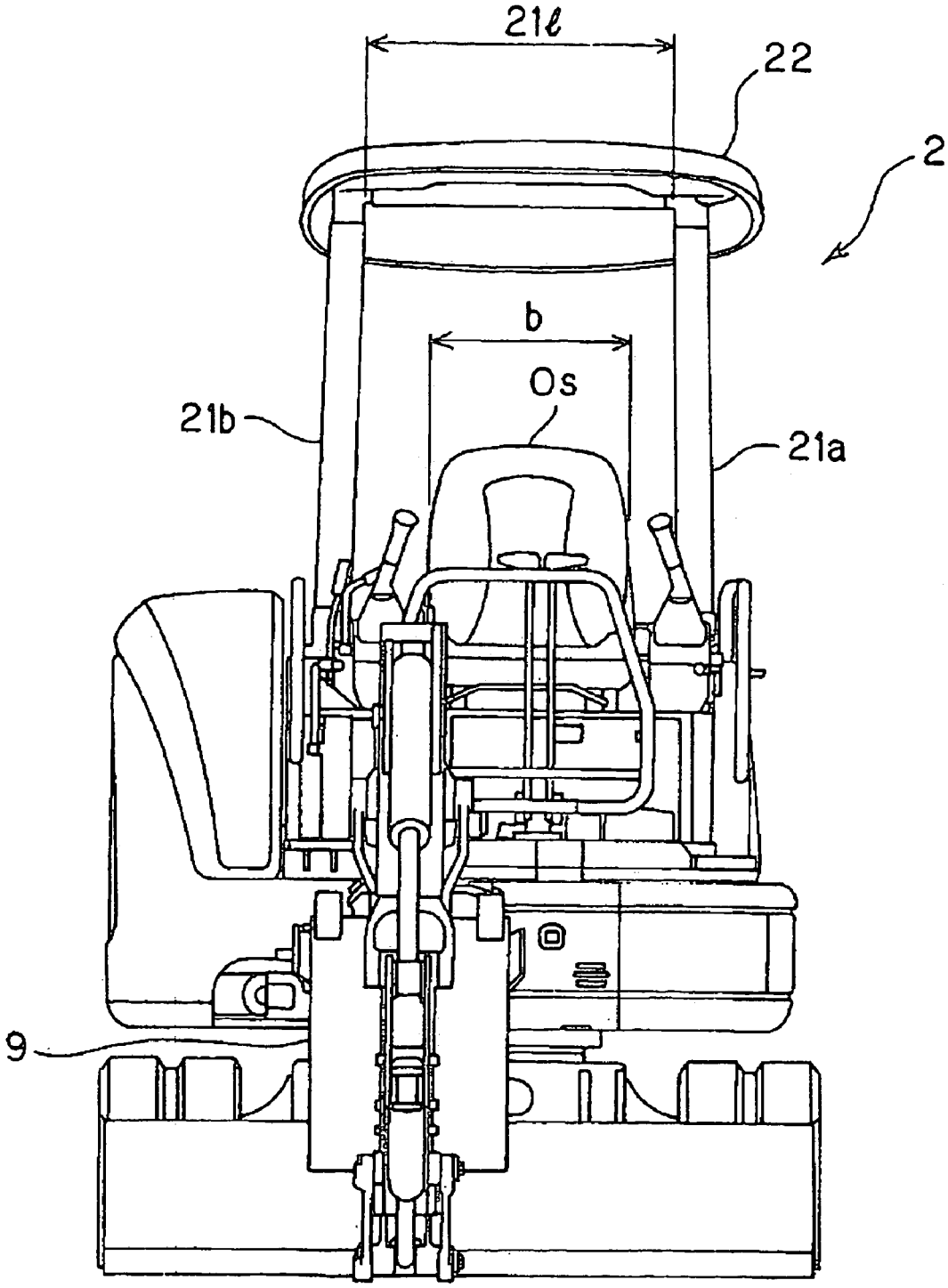
FIG. 2 is a front view illustrating the work vehicle shown in FIG. 1.

As describe above, the canopy 2 has the roof 22 supported by the two pillars 21*a* and 21*b* with an interval 211 between the supports 21*a* and 21*b*, which is wider than the width b of the operator seat Os, as shown in FIG. 2.

Since the interval 211 between the pillars 21*a* and 21*b* is wider than the width b of the operator seat Os, even when a load is applied against a lateral side of the canopy 2, a long distance between the point at which the load was applied and a pillar positioned opposite to this point (i.e., any of the pillars 21*a* and 21*b*) produces a long moment length by the load applied to the pillar, thus reducing the load by the moment applied to the pillar when the lateral load is applied.

As the interval 211 between the pillars 21*a* and 21*b* becomes wider than the width b of the operator seat Os, durability of the canopy 2 against a lateral load becomes increased. With this configuration, the canopy 2 has an increased strength against a load.

As shown in FIGS. 1 and 2, the pillars 21*a* and 21*b* of the canopy 2 are provided at the lateral side of the operator seat Os in the rear region.

Since the pillars 21*a* and 21*b* are provided at the lateral side of the operator seat Os in the rear region and the pillar interval 211 is wider than the width b of the operator seat Os, an operator operating the work vehicle has a wide and unobstructed rear field of vision, so that a favorable rear field of vision is obtained.

It is noted that the pillars 21*a* and 21*b* also may be positioned in regions directly left and right sides of the operator seat Os.

The pillars 21*a* and 21*b* positioned in the regions directly left and right sides of the operator seat Os may also provides an operator with a wide and unobstructed rear field of vision, so that a favorable rear field of vision is also obtained.

An optimal position of the pillars 21*a* and 21*b* of the canopy 2 may be provided, for example, by considering the conditions in which a vehicle body can rotate in the rear region with a small turning radius (i.e., the rear portion of the vehicle body is not extruded to the outside of crawler belts r when the working machine 9 is swiveled) and the operator seat Os is provided rearward in order to increase the operator's operation space.

In addition, to make a work vehicle more favorable, the work vehicle is required to meet the conditions of improved strength of the canopy 2 and superior field of vision ensured for the operator.

The above-described arrangement of the pillars 21*a* and 21*b* provides an optimal position of the two pillars satisfying these conditions.

As shown in FIG. 3, the counter weight 1 has an inspection hole 18 at the center part thereof. This inspection hole 18 allows an operator to easily perform operations including the inspection of the oil level or the exchange of a filter of the engine 36 provided at an engine room in front of the counter weight 1.

Figure 5:
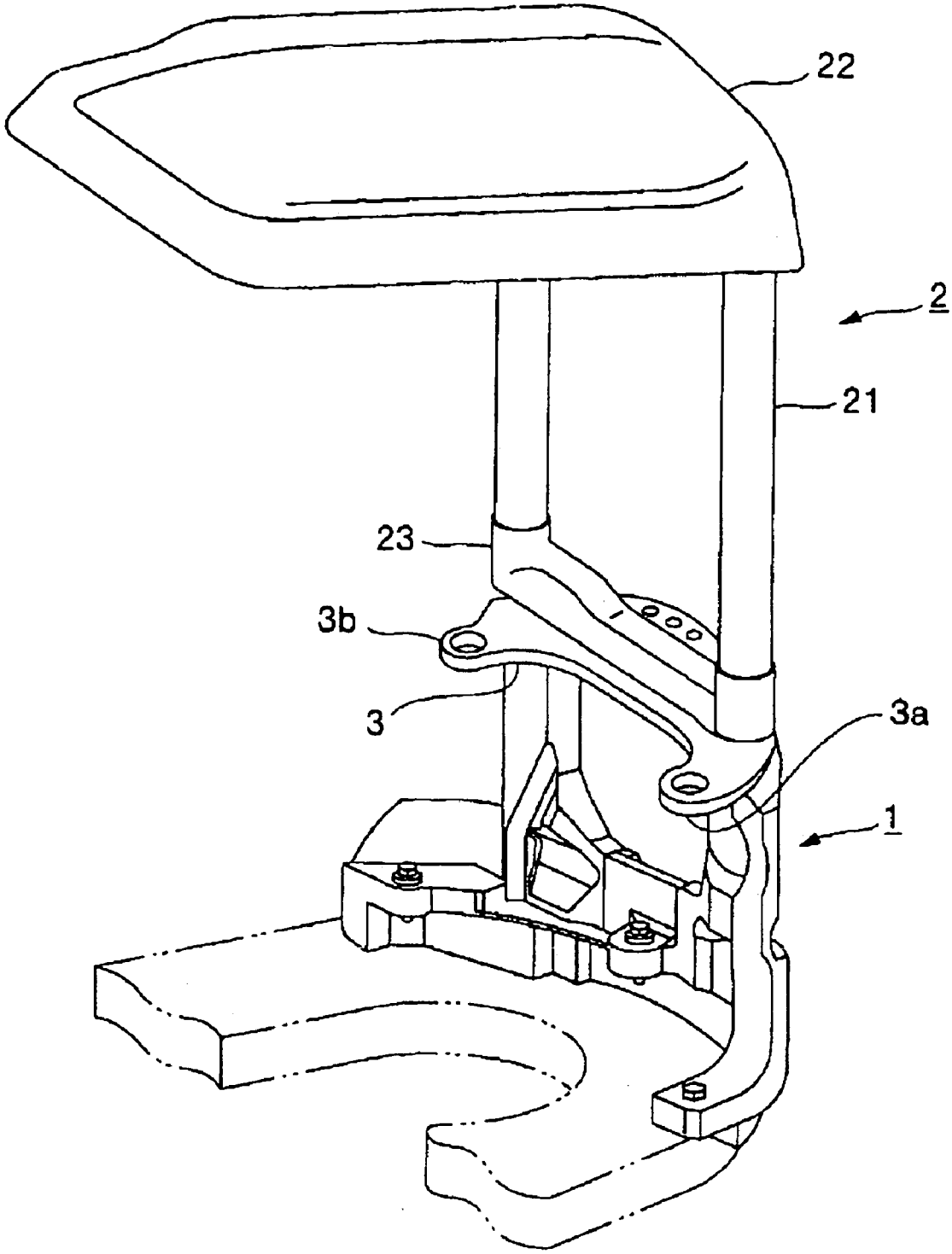
FIG. 5 is a perspective view illustrating the counter weight and the canopy with a spacer therebetween.

As shown in FIG. 5, the canopy 2 may be provided on the counter weight 1 via a spacer 3. More specifically, as shown in the partial cross-sectional view in FIG. 6, the spacer 3 is formed with canopy attachment tapped holes 31 and counter weight attachment tapped holes 32. The spacer 3 is fixed to the lower attachment bracket 23 of the canopy 2 by a plurality of bolts 33, and to the counter weight 1 by a plurality of bolts 34. The spacer 3 enables the canopy 2 to contact with the lower attachment bracket 23 in a wider width without making the canopy attachment base 16 of the upper face of the counter weight 1 in wider width, by forming the spacer 3 to have a wider width. As a result, a sufficient attachment strength can be ensured and the canopy attachment base 16 of the upper face of the counter weight is not required to have a wide width, thus preventing the engine room space 35 from being reduced.

As shown in FIG. 5, the spacer 3 also has at the left and right ends a left side floor attachment section 3*a* and a right side floor attachment section 3*b* for a floor 4.

Figure 8:
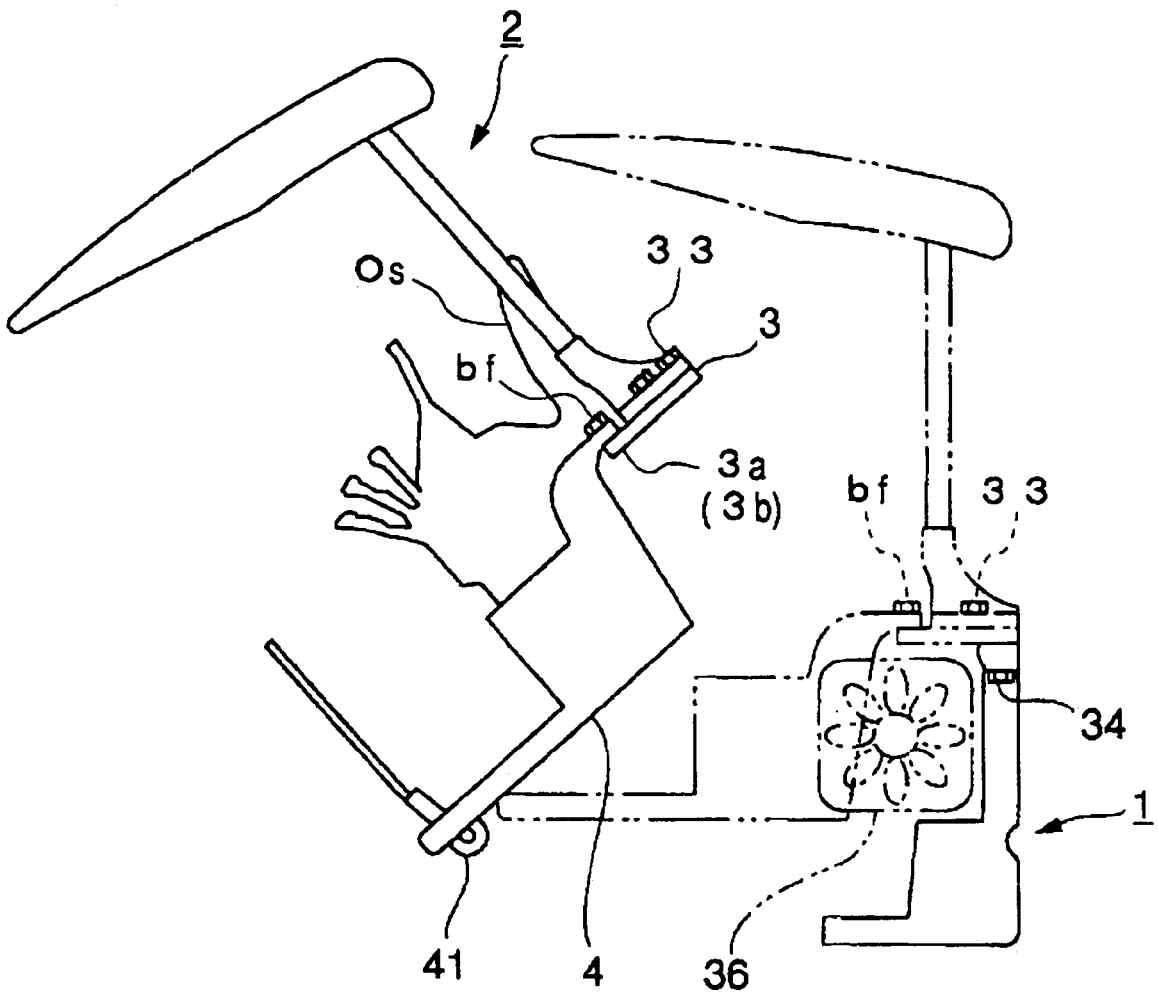
FIG. 8 is a schematic view illustrating that a floor is being tilted.
Figure 9:
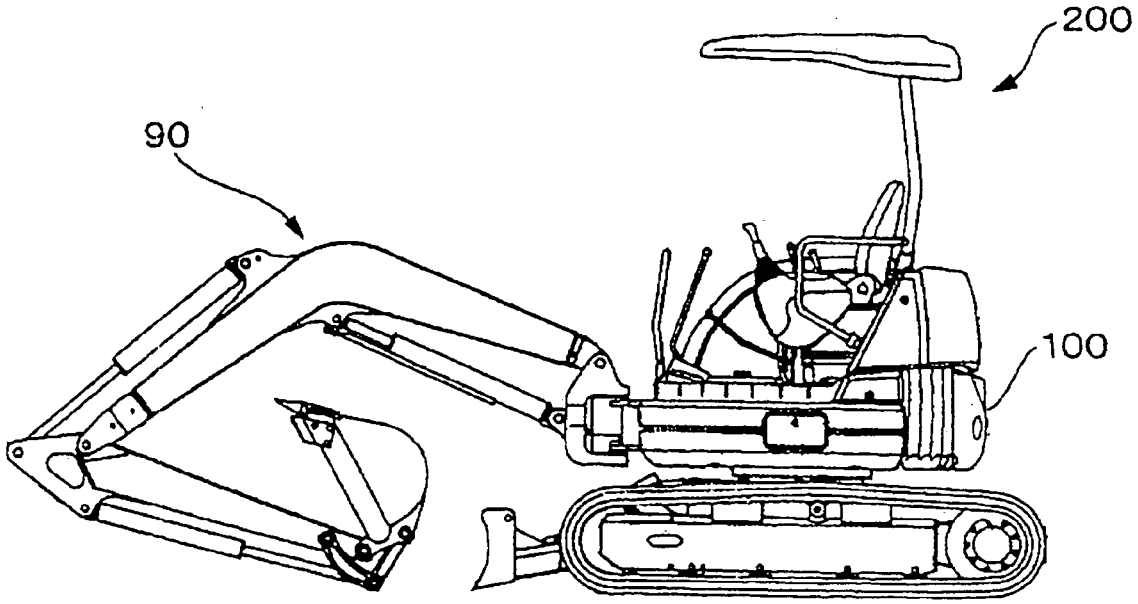
FIG. 9 PRIOR ART
FIG. 9 is a side view illustrating an example of a conventional work vehicle having a canopy.
Figure 10:
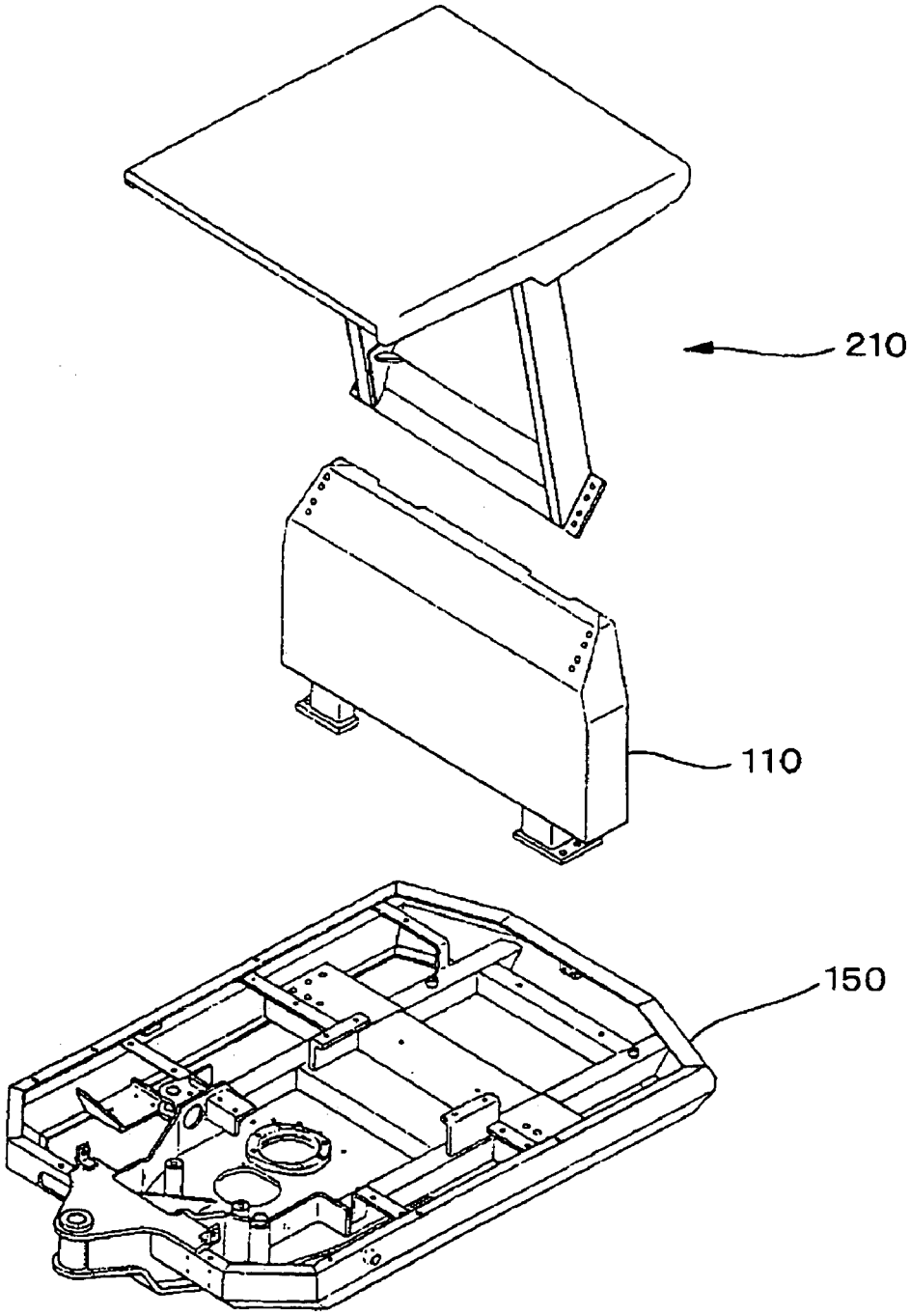
FIG. 10 PRIOR ART
FIG. 10 is an exploded view illustrating the structure of a conventional ROPS canopy, counter weight and frame.
Figure 11:
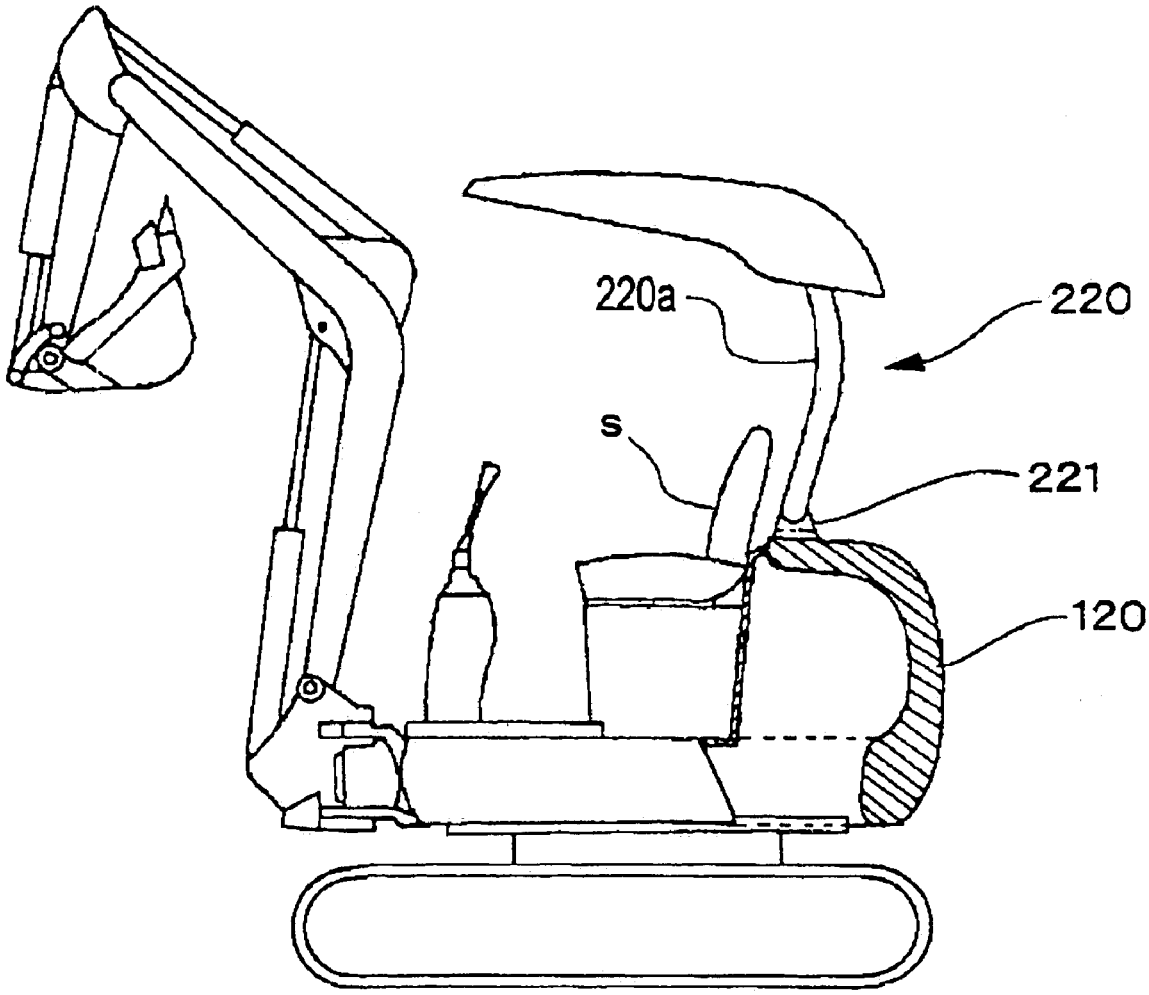
FIG. 11 PRIOR ART
FIG. 11 is a side view illustrating another example of a conventional work vehicle.

FIG. 8 illustrates that the floor 4 including the operator seat Os is attached to the floor attachment sections 3*a* and 3*b* of this spacer 3 by bolts bf.

Figure 6:
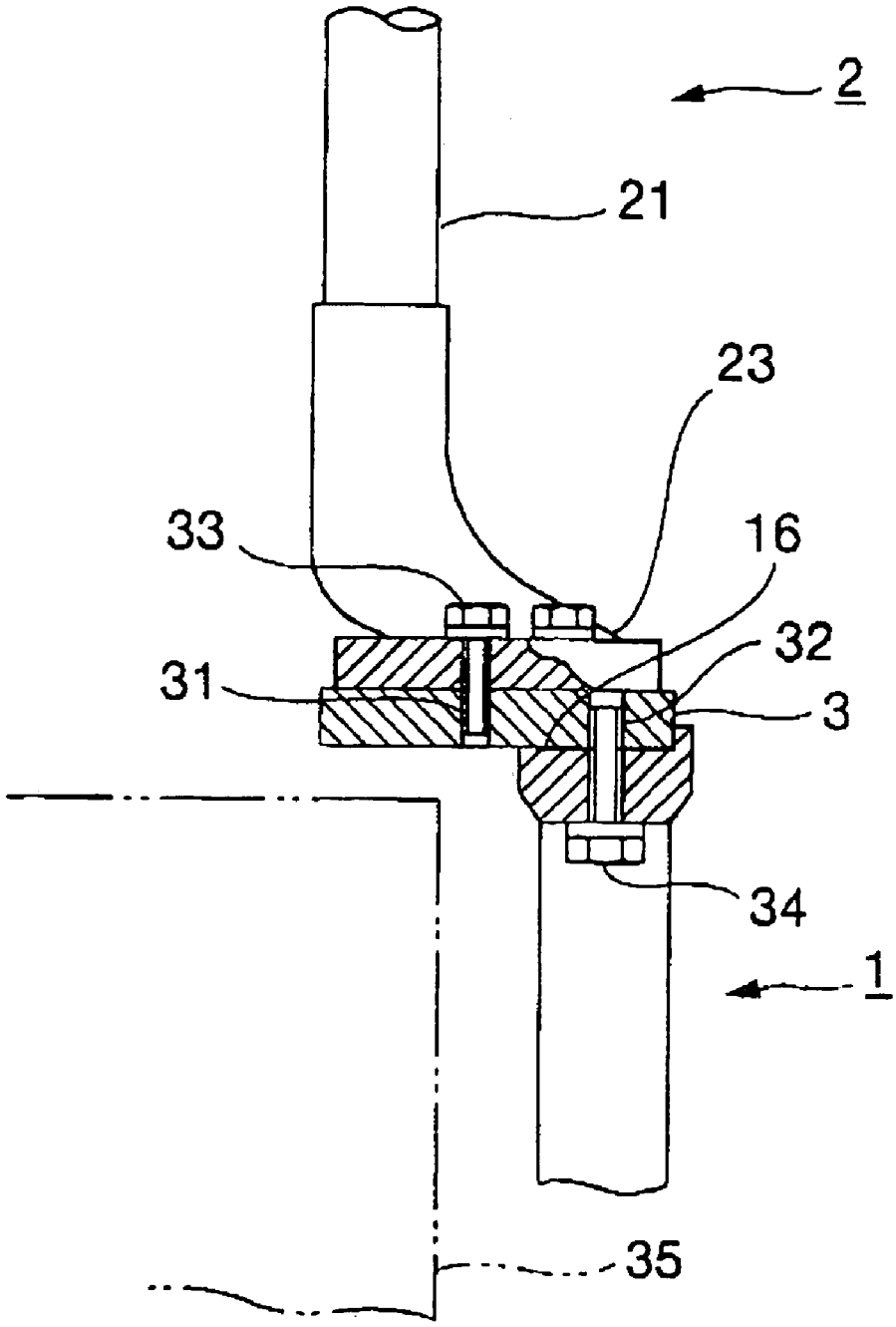
FIG. 6 is a partial cross-sectional view illustrating that the counter weight is attached with the canopy via the spacer.

Referring to FIG. 8 illustrating the floor 4 being in a tilted position, when the bolts 34 screwed with the counter weight attachment tapped hole 32 for attaching the spacer 3 to the counter weight 1 as shown in FIG. 6 is unscrewed and detached, the floor 4 together with the canopy 2 which is fixed to the floor 4 can be tilted around a hinge pin 41 of a hinge provided at the front end of the floor 4. This tilted position of the floor 4 provides the engine 36 with a wide and open upper space, thereby allowing an operator to perform inspection an maintenance operations for the engine in a very simple manner.

With the above configuration in which the counter weight 1 and the canopy 2 are connected via the spacer 3, a cabin (not shown) can be mounted in place of the canopy 2 by removing the spacer 3 and attaching the cabin to the floor 4. Thus, this configuration enables the flexible rearrangement with a higher degree of freedom for the structure of the work vehicle.

What is claimed is:

1. A work vehicle comprising:

a counter weight integrally formed by casting and including an outer surface with an arc shape, a lower section with an extended portion extending in leftward and rightward directions and having an arc shape, and tip ends of the extended portion and a lower part of a center section of the counter weight being provided with a lower attachment base, and an upper face of the counter weight being provided with a canopy attachment base; and a canopy including a roof, support members having a straight form and standing at left side and right side for supporting the roof, and a lower attachment member manufactured by casting for fixing lower ends of the support members, the canopy being mounted on the counter weight, wherein the lower attachment member of the canopy is attached to the canopy attachment base of the counter weight whereby the canopy is secured to the counter weight.

2. A work vehicle according to claim 1, further comprising:

an operator seat on which an operator sits, wherein the left and right support members are disposed with an interval therebetween wider than a width of the operator seat, and are positioned in lateral sides of the operator seat and at direct lateral regions or rear regions of the operator seat.

3. A work vehicle according to claim 2, wherein an engine is provided under the operator seat.

4. A work vehicle comprising:

a counter weight manufactured by casting an outer surface thereof being formed in a substantially arc shape, the counter weight including at a lower section thereof an extended portion extending in leftward and rightward directions to have a substantially arc shape, tip ends of the extended portion and a lower part of a center section of the counter weight being provided with a lower attachment base, the center section of the counter weight being provided with an inspection hole, and an upper face thereof being provided with a canopy attachment base; and a canopy including a roof, support members standing at left side and right side for supporting the roof, and a lower attachment member manufactured by casting for fixing lower ends of the support members, the canopy being mounted on the counter weight.

5. A work vehicle comprising:

a counter weight manufactured by casting, an outer surface thereof being formed in a substantially arc shape, the counter weight including at a lower section thereof an extended portion extending in leftward and rightward directions to have a substantially arc shape, tip ends of the extended portion and a lower part of a center section of the counter weight being provided with a lower attachment base, and an upper face thereof being provided with a canopy attachment base;

a canopy including a roof, support members standing at left side and right side for supporting the roof, and a lower attachment member manufactured by casting for fixing lower ends of the support members, the canopy being mounted on the counter weight; and a spacer formed with a canopy attachment tapped hole and a counter weight attachment tapped hole, wherein the canopy is mounted on the counter weight via the spacer.

6. A work vehicle according to claim 5, wherein the spacer is provided with floor attachment sections at opposing ends thereof.

7. A work vehicle comprising:

a counter weight;

a canopy which is mounted on the counter weight and includes a roof and left and right support members for support the roof; and an operator seat on which an operator sits, wherein the left and right support members are disposed with an interval therebetween wider than a width of the operator seat, and are positioned in lateral sides of the operator seat and at direct lateral regions or rear regions of the operator seat, and wherein the canopy includes a lower attachment member which is provided at lower parts of the left and right support members and extends around a center portion of a body of the work vehicle and which is adapted to attach the canopy to the counter weight.

8. A work vehicle according to claim 7, wherein the lower attachment member of the canopy is made by casting or forging.

9. A work vehicle, comprising:

a counter weight;

a canopy which is mounted on the counter weight and includes a roof and left and right support members for supporting the roof; and an operator seat on which an operator sits, wherein the left and right support members are disposed with an interval therebetween wider than a width of the operator seat, and are positioned in lateral sides of the operator seat and at direct lateral regions or rear regions of the operator seat, and wherein the canopy includes a lower attachment member that connects the left and right support members to each other at lower sections thereof and attaches the canopy to the counter weight.

10. A work vehicle, comprising:

a counter weight;

a canopy having a roof supported by left and right support members, and a lower attachment member provided with a lower section of the two support members; and a spacer provided between the counter weight and the lower attachment member, wherein the spacer is attached to a floor on which an operator seat is provided, the spacer and the lower attachment member are fixed by a bolt, and the spacer and the counter weight are fixed by a bolt.

11. A work vehicle, comprising a counter weight including an extended portion extending in forward and lateral directions at left and right sides of a lower section of the counter weight and provided with a lower attachment base, and a canopy attachment base provided at an upper section of the counter weight, wherein the counter weight is attached to a frame via the lower attachment base; and a canopy including a roof together with left and right support members supporting the roof is attached to the counter weight via the canopy attachment base.

12. A work vehicle according to claim 11, wherein the counter weight has a rear outer surface having a substantially arc shape face formed about a vertical axis positioned at the front side.

13. A work vehicle according to claim 11, wherein the counter weight is provided with an opening for maintenance.

14. A work vehicle according to claim 11, wherein the counter weight is made by casting.

15. A work vehicle, comprising:

a counter weight;

a canopy which is mounted on the counter weight and includes a roof and left and right support members for supporting the roof; and an operator seat on which an operator sits, wherein the left and right support members are disposed with an interval therebetween wider than a width of the operator seat, and are positioned in lateral sides of the operator seat and at direct lateral regions or rear regions of the operator seat, wherein an engine is provided under the operator seat, and wherein the canopy includes a lower attachment member that connects the left and right support members to each other at lower sections thereof and attaches the canopy to the counter weight.

* * * * *